US009151120B2

(12) United States Patent
Stowe, II

(10) Patent No.: US 9,151,120 B2
(45) Date of Patent: Oct. 6, 2015

(54) FACE STABILIZED DOWNHOLE CUTTING TOOL

(75) Inventor: Calvin J. Stowe, II, Bellaire, TX (US)

(73) Assignee: Baker Hughes Incorporated, Houston, TX (US)

( * ) Notice: Subject to any disclaimer, the term of this patent is extended or adjusted under 35 U.S.C. 154(b) by 548 days.

(21) Appl. No.: 13/487,844

(22) Filed: Jun. 4, 2012

(65) Prior Publication Data

US 2013/0319675 A1 Dec. 5, 2013

(51) Int. Cl.
*E21B 29/00* (2006.01)
*E21B 10/55* (2006.01)
*E21B 10/26* (2006.01)

(52) U.S. Cl.
CPC ..... *E21B 10/55* (2013.01); *E21B 10/26* (2013.01); *E21B 29/00* (2013.01)

(58) Field of Classification Search
CPC ..... E21B 29/002; E21B 29/00; E21B 10/00; E21B 10/26
USPC ..... 166/55.6, 298; 175/385, 431, 406, 430
See application file for complete search history.

(56) References Cited

U.S. PATENT DOCUMENTS 2,169,223 A * 8/1939 Christian ..... 175/317
4,259,033 A 3/1981 McCreery et al.
4,357,122 A 11/1982 Hollis, Jr. et al.
4,440,247 A * 4/1984 Sartor ..... 175/393
4,593,777 A 6/1986 Barr
4,717,290 A 1/1988 Reynolds et al.
4,796,709 A 1/1989 Lynde et al.
4,934,878 A 6/1990 Plutschuck et al.
4,978,260 A 12/1990 Lynde et al.
4,984,488 A 1/1991 Lunde et al.
5,027,914 A 7/1991 Wilson
5,058,666 A 10/1991 Lynde et al.
5,150,755 A 9/1992 Cassel et al.
5,297,630 A 3/1994 Lynde et al.
5,373,900 A 12/1994 Lynde et al.
5,456,312 A 10/1995 Lynde et al.
5,460,233 A 10/1995 Meany et al.
5,649,604 A * 7/1997 Fuller et al. ..... 175/431

(Continued)

FOREIGN PATENT DOCUMENTS

EP 0234697 A2 9/1987
EP 0874127 A2 10/1998

OTHER PUBLICATIONS

Jim McNicol, et al., First true, CT underbalanced casing exit performed, World Oil, Mar. 2005, pp. 25-26, Gulf Publishing Company, USA.

*Primary Examiner* — Daniel P Stephenson
(74) *Attorney, Agent, or Firm* — Steve Rosenblatt

(57) ABSTRACT

Downhole cutting tools such as blade mills comprise a body having an upper end for connection with a rotating component of a drill string and a guide member disposed at lower end. The guide member can comprise a shape that is reciprocal to an engagement member disposed on an object within the well that is to be cut by the cutting mill. In certain embodiments, the guide member comprises a portion that is spherically shaped or an apex formed by two angled cutting elements. The cutting tools can also include one or more blades having cutting elements disposed thereon in a stepped arrangement. In one such embodiment, the cutting elements are disposed to cover one or more steps profiled on a lower end of the blade to lessen wear of the blade caused by the cutting of the object by the blade.

15 Claims, 5 Drawing Sheets

(56) References Cited

U.S. PATENT DOCUMENTS

| | | | | |
|---|---|---|---|---|
| 5,685,671 | A | 11/1997 | Packer et al. | |
| 5,810,079 | A | 9/1998 | Lynde et al. | |
| 5,899,268 | A | 5/1999 | Lynde et al. | |
| 5,979,571 | A * | 11/1999 | Scott et al. | 175/61 |
| 6,106,585 | A | 8/2000 | Packer et al. | |
| 6,131,675 | A * | 10/2000 | Anderson | 175/268 |
| 6,155,343 | A | 12/2000 | Nazzal et al. | |
| 6,167,958 | B1 | 1/2001 | Lynde | |
| 6,422,328 | B1 | 7/2002 | Holland et al. | |
| 6,464,434 | B2 | 10/2002 | Lynde | |
| 7,225,886 | B1 * | 6/2007 | Hall | 175/57 |
| 7,363,992 | B2 | 4/2008 | Stowe et al. | |
| 7,513,319 | B2 | 4/2009 | DeVall | |
| 7,591,327 | B2 * | 9/2009 | Hall et al. | 175/56 |
| 7,823,665 | B2 * | 11/2010 | Sullivan et al. | 175/425 |
| 8,281,882 | B2 * | 10/2012 | Hall et al. | 175/385 |
| 2003/0213621 | A1 * | 11/2003 | Britten et al. | 175/404 |
| 2005/0039905 | A1 | 2/2005 | Hart et al. | |
| 2005/0109546 | A1 | 5/2005 | Stowe et al. | |
| 2005/0150656 | A1 | 7/2005 | Stowe | |
| 2005/0269139 | A1 | 12/2005 | Shen et al. | |
| 2006/0090897 | A1 | 5/2006 | Stowe et al. | |
| 2007/0023188 | A1 | 2/2007 | Roberts et al. | |
| 2008/0006446 | A1 | 1/2008 | Stowe et al. | |
| 2008/0149393 | A1 | 6/2008 | McClain et al. | |
| 2008/0156541 | A1 * | 7/2008 | Hall et al. | 175/296 |
| 2008/0296070 | A1 | 12/2008 | Shen et al. | |
| 2008/0302578 | A1 | 12/2008 | Eyre et al. | |
| 2008/0308276 | A1 | 12/2008 | Scott | |
| 2010/0012387 | A1 | 1/2010 | Huynh et al. | |
| 2010/0084198 | A1 | 4/2010 | Durairajan et al. | |
| 2010/0108402 | A1 | 5/2010 | Ponder et al. | |
| 2011/0192653 | A1 | 8/2011 | Stowe, II | |
| 2011/0203856 | A1 | 8/2011 | Lynde | |
| 2011/0315447 | A1 | 12/2011 | Stowe, II | |
| 2011/0315448 | A1 | 12/2011 | Stowe, II | |
| 2011/0315455 | A1 | 12/2011 | Stowe, II | |
| 2013/0319675 | A1 * | 12/2013 | Stowe, II | 166/298 |

* cited by examiner

FACE STABILIZED DOWNHOLE CUTTING TOOL

BACKGROUND

1. Field of Invention

The invention is directed to downhole cutting tools utilized in oil and gas wells to cut objects within the well and, in particular, to downhole blade mills that are used to cut away, among other objects, stuck tools, bridge plugs, well tubing, well casing, and the like disposed within the well.

2. Description of Art

In the drilling, completion, and workover of oil and gas wells, it is common to perform work downhole in the wellbore with a tool that has some sort of cutting profile interfacing with a downhole structure. Examples would be milling a downhole metal object with a milling tool, performing a washover operation with a rotary shoe, or cutting through a tubular with a cutting or milling tool. During the performance of these operations, it is common for the tool and/or drill string to which the tool is connected, to vibrate or bounce off of the object disposed within the wellbore that is being cut or abraded, causing inefficiencies in the cutting operations.

SUMMARY OF INVENTION

Broadly, the invention is directed to downhole cutting tools utilized in cutting (also referred to as abrading or milling) an object disposed within the well. The term "object" encompasses any physical structure that may be disposed within a well, for example, another tool that is stuck within the well, a bridge plug, the well tubing, the well casing, or the like. The downhole cutting tools disclosed herein include cutting elements disposed on a body. The cutting elements can be disposed on an outer wall surface of the body, or on blades disposed along the outer wall surface of the tool. The cutting elements are disposed on the body such that rotation of the body causes rotation of the cutting elements.

In one particular embodiment, the downhole cutting tool comprises a guide member disposed at an end of the tool. The guide member facilitates engagement of the tool with an object disposed in a wellbore. By engaging the guide member with the object, the tool rotation will follow a more circular path, thereby reducing the magnitude of lateral motion during cutting operations.

In other specific embodiments, the downhole cutting tools comprise cutting elements arranged in a staggered pattern. The cutting elements can be disposed directly on an outer wall surface of the body of the tool, or on one or more blades attached to the body of the tool.

While the invention will be described in connection with the preferred embodiments, it will be understood that it is not intended to limit the invention to these embodiments. On the contrary, it is intended to cover all alternatives, modifications, and equivalents, as may be included within the spirit and scope of the invention as defined by the appended claims.

DETAILED DESCRIPTION OF INVENTION

Figure 1:
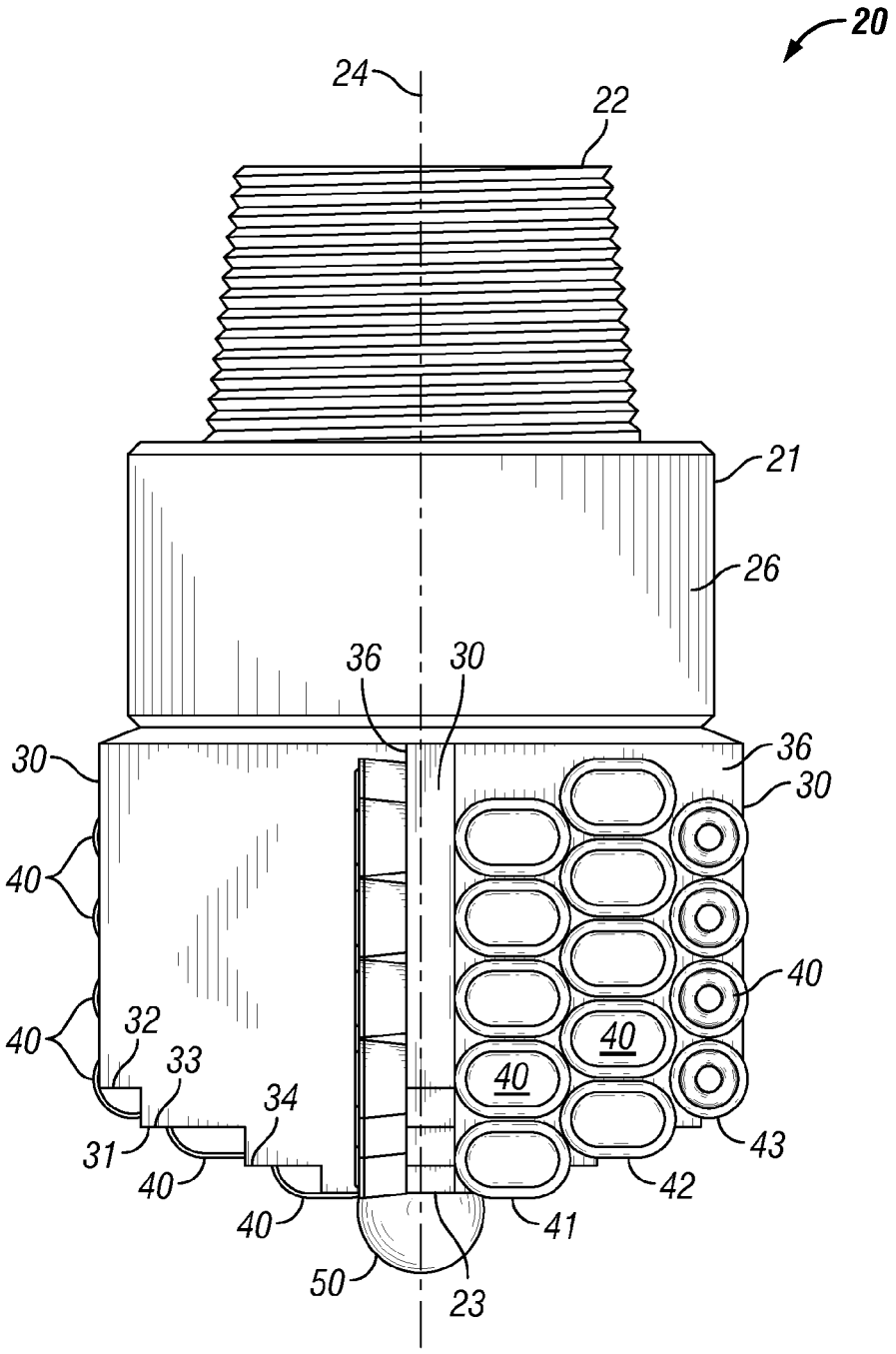
FIG. 1 is a side view of one specific embodiment of a downhole cutting tool disclosed herein.
Figure 2:
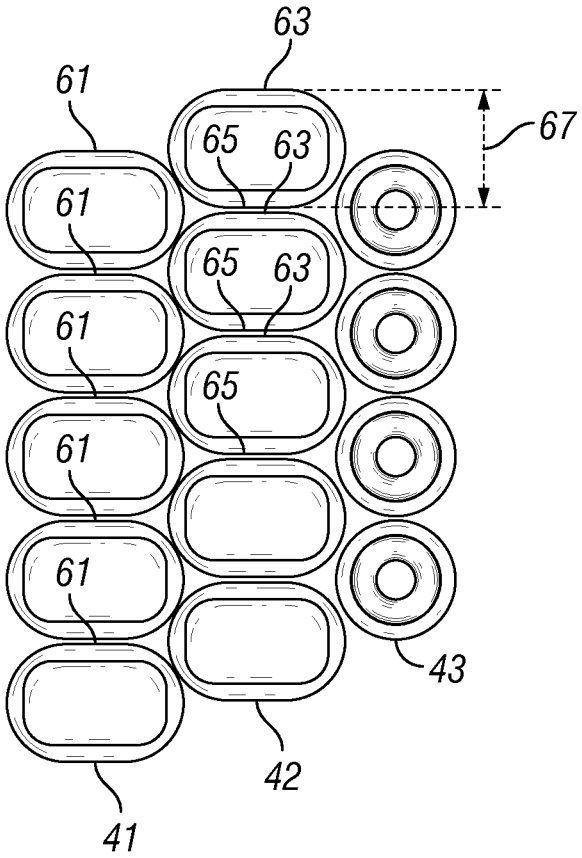
FIG. 2 is an enlarged view of the cutting elements shown on the embodiment illustrated in FIG. 1.
Figure 3:
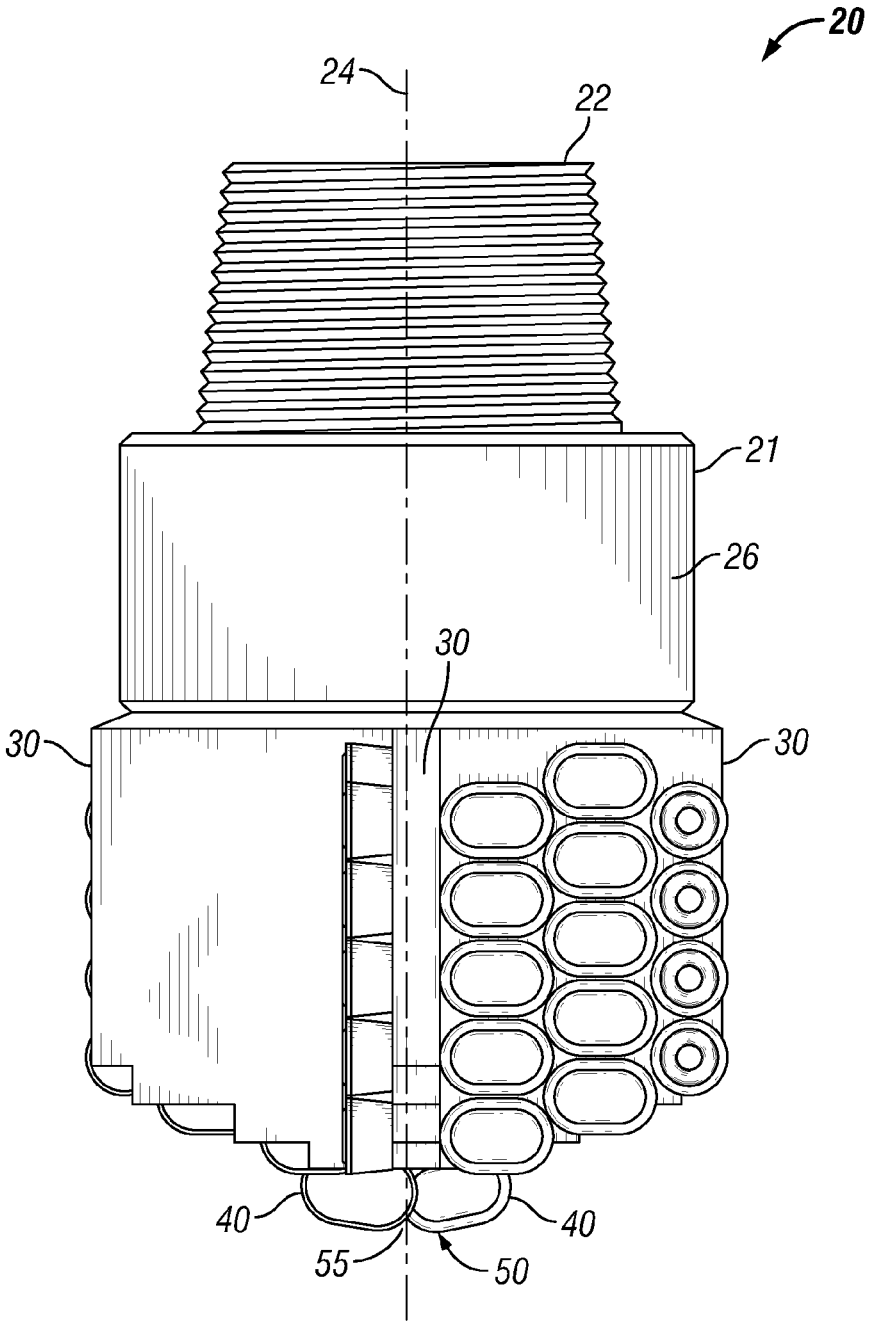
FIG. 3 is a side view of another specific embodiment of a downhole cutting tool disclosed herein.

Referring now to FIGS. 1-3, downhole cutting tool 20 comprises body 21 having first or upper end 22, second or lower end 23, and longitudinal axis 24. First or upper end 22 is adapted to be connected to a drill or work string 80 (FIGS. 4-5), such as through a threaded connection shown in FIGS. 1 and 3. Cutting elements 40 are disposed along outer wall surface 26 of body 21. In the embodiments of FIGS. 1-3, cutting elements 40 are disposed on a plurality of blades 30. It is to be understood, however, that blades 30 are not required. Instead, cutting elements 40 can be disposed directly on outer wall surface 26 or on any other structure desired or necessary to facilitate cutting of an object disposed in a wellbore.

In the embodiments shown in the FIGS. 1-5, tool 20 is a blade mill having a plurality of blades 30. One or more of blades 30 can be a "stepped blade" having a stepped profile along cutting end 31 such as shown in FIGS. 1 and 3. As shown in FIGS. 1 and 3, the profile along cutting end 31 includes first, second, and third steps 32, 33, 34. Thus, in the embodiments of FIGS. 1-5, tool 20 is a "stepped blade mill."

Although the cutting elements 40 can be disposed on cutting faces 36 in numerous arrangements, in the embodiments of FIGS. 1-5, cutting elements 40 are disposed on cutting faces 36 of blades 30 in three columns. First column 41 is disposed parallel to, and closest to, longitudinal axis 24. Second column 42 is disposed adjacent first column 41 and parallel to longitudinal axis 24. Third column 43 is disposed adjacent second column 42 and parallel to longitudinal axis 24. Third column 43 of cutting elements 40 is the furthest from longitudinal axis 24 and closest to the outer edge of cutting face 36.

In addition to being disposed in columns, cutting elements 40 of first column are disposed in a staggered relationship relative to cutting elements 40 of second column. Similarly, cutting elements of second column 42 are disposed in a staggered relationship relative to cutting elements 40 of third column 43. As best shown in FIG. 2, in one particular embodiment, cutting elements 40 of first column 41 are offset relative to cutting elements 40 of second column 42 such that upper surfaces 61 of one or more of cutting elements 40 of first column 41 is not aligned with upper surface 63 or a lower surface 65 of an adjacent cutting element 40 of the second column 42. In other words, upper surface 61 of one or more cutting elements 40 of first column 41 is level with a point disposed along height 67 between upper surface 63 and lower surface 65 of at least one cutting element 40 of second column 42. The point can be disposed half-way between upper surface 63 and the lower surface 65, i.e., the mid-point (as shown in FIGS. 1-3), or any other point in-between.

Additionally, as illustrated in FIGS. 1 and 3, the lowermost cutting element 40 of each of first, second, and third columns 41, 42, 43 is disposed such that cutting elements 40 extend beyond (i.e., away from the cutting end 31) the stepped profile along cutting surface 31 that defines first, second, and third steps 32, 33, 34. The arrangement of cutting elements 40 in this manner lessens exposure of blades 30, and cutting surface 36 to the object so that cutting elements 40 can more efficiently cut the object disposed in the well.

Disposed at lower end 23 of body 21 is guide member 50. Guide member 50 extends beyond lower end 23 for engagement with the object disposed in the wellbore. Guide member 50 includes a profile for engaging with the an engagement member disposed on the object to stabilize cutting tool 20 during cutting of the object. The profile of guide member 50 can include at least a partial spherical shape (FIG. 1), or tool apex 55 (FIG. 3) defined by one or more cutting elements 40 being disposed on lower end 23. In embodiments in which cutting elements 40 define apex 55, one or more of cutting elements 40 can be disposed at non-right angles relative to lower end 23 as shown in FIG. 3. In addition, in embodiments in which at least two cutting elements 40 define apex 55, at least two of the cutting elements 40 can be disposed facing each other. Inclusion of cutting elements 40 as guide member 50 allows guide member 50 to cut or abrade the object in addition to providing stability to the downhole tool 20 during operation. In other words, during rotation of the work string containing downhole tool 20, cutting elements 40 of guide member 50 cut an opening in the object into which guide member 50 is inserted so as to stabilize downhole tool 20 during further cutting of the object. Thus, guide member 50 having one or more cutting elements 40 cuts an opening large enough such that guide member can enter and engage the interior surface of the object to provide stabilization.

Figure 4:
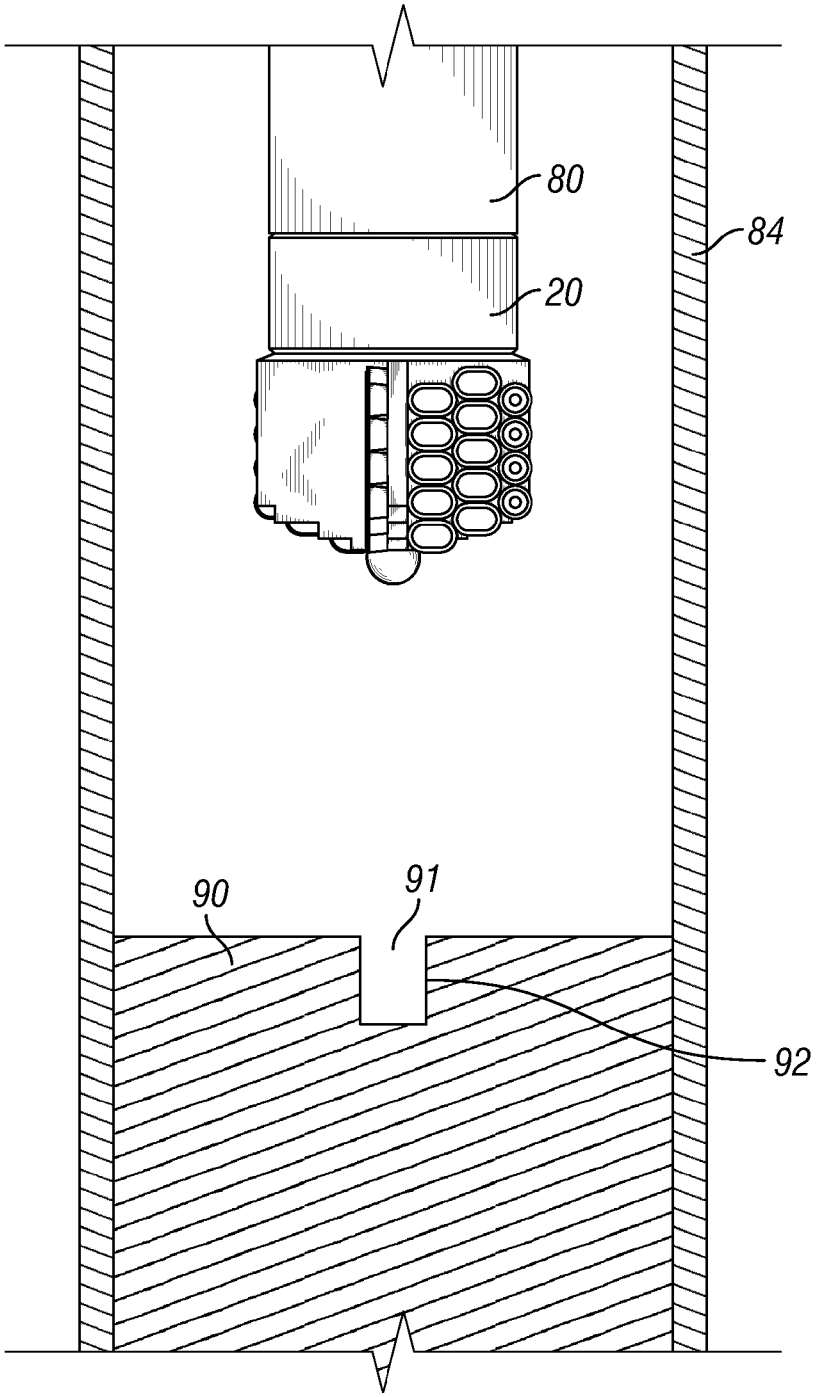
FIG. 4 is a partial cross-sectional view of an object disposed in a wellbore showing the downhole tool of FIG. 1 being lowered to engage the object.
Figure 5:
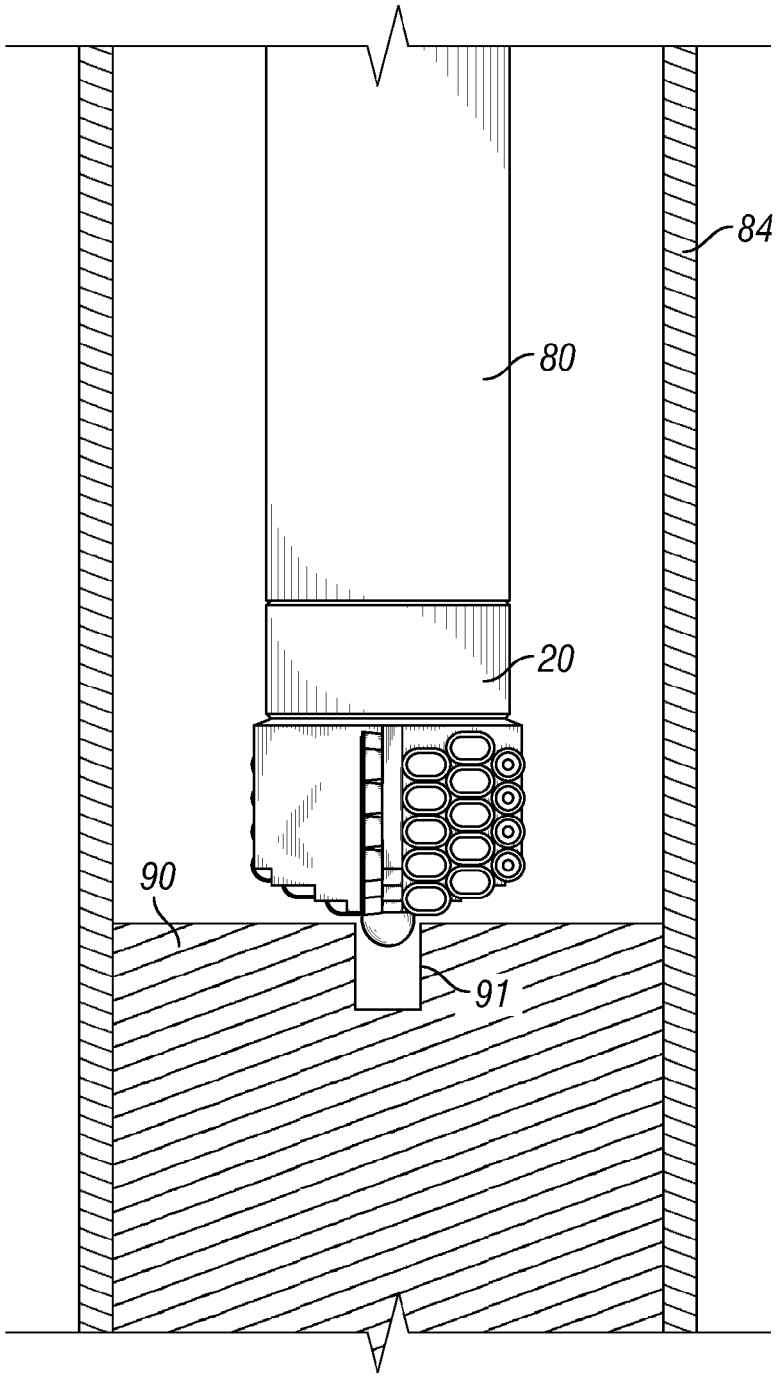
FIG. 5 is a partial cross-sectional view of the object disposed in the wellbore shown in FIG. 4 showing the downhole tool of FIG. 1 engaged with the object prior to rotation of the tool and, thus, cutting of the object.

Referring now to FIGS. 4-5, downhole cutting tool 20 is secured to drill string 80 and disposed within wellbore 84. Disposed within wellbore 84 is object 90 having engagement member 91 defining engagement member interior surface 92. The profile of guide member 50 of tool 20 is shaped to be received by engagement member 91. As used herein, "received" is understood to have its broadest meaning requiring only that guide member 50 is able to engage with engagement member 91. It is to be understood that the engagement between guide member 50 and engagement member 91 is not required to have a low tolerance fit. All that is required is that guide member 50 can engage with engagement member 91 such that tool 20 and, thus, drill string 80, are stabilized during cutting operations thereby preventing tool 20 or string 80 to experience vibration or bounce causing a decrease in the efficiency of the cutting as compared to a tool lacking guide member 50. In one particular embodiment, engagement member 91 comprises a bore that extends the entire longitudinal length of object 90. In other embodiments, engagement member 91 comprises a recess reciprocally-shaped to the shape or profile of guide member 50. For example, engagement member 91 can be a concave-shaped recess to receive spherical-shaped guide member 50 (FIG. 1).

In operation, drill string 80 is lowered within wellbore 84 (FIG. 2) until guide member 50 engages with engagement member 91 of object 90 (FIG. 5). Drill string 80 is rotated causing cutting elements 40 to cut or abrade away object 90. Due to the outer diameter of drill string 80 being smaller than the inner diameter of wellbore 84, drill string 80 is prone to vibrate or bounce upward off of object 90. To lessen the likelihood of this happening, the engagement of guide member 50 with engagement member 91 stabilizes tool 20 and, thus, drill string 80. Drill string 80 continues to rotate and move downward as object 90 is cut or abraded away. The rotation and cutting continues until object 90 is removed from wellbore 84. Thereafter, drill string 80 is removed from wellbore 84 so that other downhole operations can be performed within wellbore 84.

It is to be understood that the invention is not limited to the exact details of construction, operation, exact materials, or embodiments shown and described, as modifications and equivalents will be apparent to one skilled in the art. For example, the materials forming the components, the dimensions of each of the components, and the arrangement of the cutting elements can be modified as desired or necessary effectuate the best device for cutting an object disposed in a well. In addition, the guide member is not required to be spherically-shaped or be composed of angled cutting elements. Other guide members and their equivalents can be included as part of certain of the embodiments disclosed herein. Moreover, the cutting elements are not required to have the shapes and dimensions disclosed herein. Additionally, although the upper surfaces and lower surfaces of the cutting elements of the first and second columns are discussed with respect to specific reference numerals, it is to be understood that all of the cutting elements include an upper surface, a lower surface, and a height in the same manner as those discussed with respect to the cutting elements of the first and second columns. Further, it is to be understood that the term "wellbore" as used herein includes open-hole, cased, or any other type of wellbores. In addition, the use of the term "well" is to be understood to have the same meaning as "wellbore." Moreover, in all of the embodiments discussed herein, upward, toward the surface of the well (FIGS. 4-5), is toward the top of Figures, and downward or downhole (the direction going away from the surface of the well) is toward the bottom of the Figures. However, it is to be understood that the tools may have their positions rotated in either direction any number of degrees. Accordingly, the tools can be used in any number of orientations easily determinable and adaptable to persons of ordinary skill in the art. In addition, referring to a component as being "upper" or "lower" does not dictate the orientation of the component when placed in a well. Accordingly, the invention is therefore to be limited only by the scope of the appended claims.

What is claimed is:

1. A downhole cutting tool for use in a well, the downhole cutting tool comprising:

a body having a first end for connection with a rotating component of a drill string, a second end for engaging an object disposed in a well, and a plurality of cutting elements disposed along the body for cutting the object, said body further comprising a longitudinal axis and at least one of said cutting elements having a lowermost axial position with respect to said longitudinal axis;

wherein the second end includes a fixedly mounted guide member extending axially over the length of its non-cutting spherical shape profile beyond said at least one cutting element for engaging with an interior surface of the object to stabilize the cutting tool during cutting of the object, said guide member having said spherical shape profile for the entirety of its extension beyond said cutting element with said lowermost axial.

2. The downhole tool of claim 1, wherein the body further includes a plurality of blades disposed along a longitudinal axis of the body.

3. The downhole tool of claim 2, wherein at least one of the plurality of blades includes a first column of cutting elements disposed parallel to the longitudinal axis of the body and a second column of cutting elements disposed parallel to the longitudinal axis of the body and adjacent to the first column of cutting elements, the cutting elements of the first column being offset relative to the cutting elements of the second column such that an upper surface of one or more of the cutting elements of the first column is not aligned with an upper surface or a lower surface of an adjacent cutting element of the second column.

4. A downhole cutting tool for use in a well, the downhole cutting tool comprising:

a body having a first end for connection with a rotating component of a drill string, a second end for engaging an object disposed in a well, and at least one cutting element disposed along the body for cutting the object, wherein the second end includes a guide member extending from the second end, the guide member having a profile for engaging with an interior surface of the object to stabilize the cutting tool during cutting of the object, the profile having a non-cutting spherical-shape;

the body further includes a plurality of blades disposed along a longitudinal axis of the body;

at least one of the plurality of blades includes a first column of cutting elements disposed parallel to the longitudinal axis of the body and a second column of cutting elements disposed parallel to the longitudinal axis of the body and adjacent to the first column of cutting elements, the cutting elements of the first column being offset relative to the cutting elements of the second column such that an upper surface of one or more of the cutting elements of the first column is not aligned with an upper surface or a lower surface of an adjacent cutting element of the second column;

at least one of the plurality of blades includes a stepped-profile at a cutting end of the blade, the stepped profile defining a first step and a second step, and a first cutting element extending beyond the first step away from the cutting end and a second element extending beyond the second step away from the cutting end.

5. A downhole cutting tool for use in a well, the downhole cutting tool comprising:

a body having a first end for connection with a rotating component of a drill string, a second end for engaging an object disposed in a well, and at least one cutting element disposed along the body for cutting the object, wherein the second end includes a guide member extending from the second end, the guide member having a profile for engaging with an interior surface of the object to stabilize the cutting tool during cutting of the object, the profile having at least one cutting element disposed on the second end to define the profile, the at least one cutting element milling an opening in the object into which the guide member is inserted during cutting of the object;

the body further includes a plurality of blades disposed along a longitudinal axis of the body, wherein at least one of the plurality of blades includes a first column of cutting elements disposed parallel to the longitudinal axis of the body and a second column of cutting elements disposed parallel to the longitudinal axis of the body and adjacent to the first column of cutting elements, the cutting elements of the first column being offset relative to the cutting elements of the second column such that an upper surface of one or more of the cutting elements of the first column is not aligned with an upper surface or a lower surface of an adjacent cutting element of the second column;

at least one of the plurality of blades includes a stepped-profile at a cutting end of the blade, the stepped profile defining a first step and a second step, and a first cutting element extending beyond the first step away from the cutting end and a second element extending beyond the second step away from the cutting end.

6. In combination, a blade mill for cutting an object disposed in a well, the combination comprising:

a blade mill having a body having an upper end for connecting the blade mill to a drill string, a lower end, and an outer wall surface having at least one blade having at least one cutting element disposed thereon;

an object, disposed in a well, to be milled;

a non-cutting guide member disposed on the lower end of said blade mill, the guide member having a guide member spherical shape for entry into an engagement member disposed on said object, said guide member engaging said engagement member disposed on said object during operation of said blade mill facilitating stabilization of said blade mill during operation.

7. The blade mill of claim 6, wherein the guide member comprises a spherical-shaped portion.

8. The blade mill of claim 7, wherein each blade comprises a first column of cutting elements and a second column of cutting elements, the first column and second column being disposed adjacent each other and parallel to a longitudinal axis of the body, and the first column of cutting elements disposed in a staggered relationship relative to the second column of cutting elements.

9. A blade mill for cutting an object disposed in a well, the blade mill comprising:

a body having an upper end for connecting the blade mill to a drill string, a lower end, and an outer wall surface having at least one blade having at least one cutting element disposed thereon; and a guide member disposed on the lower end, the guide member having a guide member shape that is reciprocal to an engagement member disposed on an object disposed in a well, the guide member engaging the engagement member disposed on the object during operation of the blade mill facilitating stabilization of the blade mill during operation;

the guide member comprises a spherical-shaped portion;

each blade comprises a first column of cutting elements and a second column of cutting elements, the first column and second column being disposed adjacent each other and parallel to a longitudinal axis of the body, and the first column of cutting elements disposed in a staggered relationship relative to the second column of cutting elements;

the first column of cutting elements are staggered relative to the second column of cutting elements such that the top of at least one cutting element in the first column of cutting elements is level with a mid-point of a height of at least one cutting element of the second column of cutting elements.

10. In combination, a blade mill for cutting an object disposed in a well, the combination comprising:

a blade mill having a body having an upper end for connecting the blade mill to a drill string, a lower end, and an outer wall surface having at least one blade having at least one cutting element disposed thereon;

an object, disposed in a well, to be milled;

a guide member disposed on the lower end of said blade mill, the guide member having a guide member shape for entry into an engagement member disposed on said object, said guide member engaging said engagement member disposed on said object during operation of said blade mill facilitating stabilization of said blade mill during operation;

wherein said guide member comprises at least two cutting elements disposed facing each other to define a mill apex.

11. The downhole cutting tool of claim 10, wherein each of the at least two cutting elements of the guide member is disposed at non-right angles relative to the lower end to define the mill apex.

12. The blade mill of claim 10, wherein each blade comprises a first column of cutting elements and a second column of cutting elements, the first column and second column being disposed adjacent each other and parallel to a longitudinal axis of the body, and the first column of cutting elements disposed in a staggered relationship relative to the second column of cutting elements.

13. A blade mill for cutting an object disposed in a well, the blade mill comprising:

a body having an upper end for connecting the blade mill to a drill string, a lower end, and an outer wall surface having at least one blade having at least one cutting element disposed thereon; and a guide member disposed on the lower end, the guide member having a guide member shape that is reciprocal to an engagement member disposed on an object disposed in a well, the guide member engaging the engagement member disposed on the object during operation of the blade mill facilitating stabilization of the blade mill during operation;

the guide member comprises at least two cutting elements disposed facing each other to define a mill apex;

each blade comprises a first column of cutting elements and a second column of cutting elements, the first column and second column being disposed adjacent each other and parallel to a longitudinal axis of the body, and the first column of cutting elements disposed in a staggered relationship relative to the second column of cutting elements;

the first column of cutting elements are staggered relative to the second column of cutting elements such that the top of at least one cutting element in the first column of cutting elements is level with a mid-point of a height of at least one cutting element of the second column of cutting elements.

14. A method of cutting an object in a well comprising the steps of:

(a) engaging a mill with an object disposed in the wellbore, the mill comprising a body having an upper end for connecting the mill to a work string, a lower end, and an outer wall surface having at least one cutting element, the lower end including a spherical non-cutting guide member, for engaging with an interior surface of an engagement member disposed on the object disposed in the well;

(b) inserting the guide member in the engagement member disposed on the object; and (c) rotating the mill to cut away the object with at least one of the at least one cutting elements disposed on the outer wall surface of the body, the mill being stabilized with respect to the object due to the engagement of the guide member with the engagement member disposed on the object.

15. A method of cutting an object in a well comprising the steps of:

(a) engaging a mill with an object disposed in the wellbore, the mill comprising a body having an upper end for connecting the mill to a work string, a lower end, and an outer wall surface having at least one cutting element, the lower end including a guide member, for engaging with an interior surface of an engagement member disposed on the object disposed in the well;

(b) inserting the guide member in the engagement member disposed on the object; and (c) rotating the mill to cut away the object with at least one of the at least one cutting elements disposed on the outer wall surface of the body, the mill being stabilized with respect to the object due to the engagement of the guide member with the engagement member disposed on the object and wherein during step (c) the guide member cuts the object.

* * * * *